US008118280B2

(12) United States Patent
Heinz

(10) Patent No.: US 8,118,280 B2
(45) Date of Patent: Feb. 21, 2012

(54) MODULAR VEHICLE RAMP SYSTEM

(76) Inventor: Richard Heinz, Gladstone, MI (US)

( * ) Notice: Subject to any disclaimer, the term of this patent is extended or adjusted under 35 U.S.C. 154(b) by 343 days.

(21) Appl. No.: 12/358,326

(22) Filed: Jan. 23, 2009

(65) Prior Publication Data

US 2009/0189130 A1 Jul. 30, 2009

Related U.S. Application Data

(60) Provisional application No. 61/062,200, filed on Jan. 25, 2008.

(51) Int. Cl.
*B66F 7/24* (2006.01)

(52) U.S. Cl. ..... 254/88

(58) Field of Classification Search ..... 254/88, 254/134, DIG. 1; 14/71.5, 69.5
See application file for complete search history.

(56) References Cited

U.S. PATENT DOCUMENTS

| | | | | |
|---|---|---|---|---|
| 3,752,441 | A | 8/1973 | Rogers | |
| 4,427,179 | A | 1/1984 | Price | |
| 4,920,596 | A | 5/1990 | Stevens | |
| 5,863,026 | A * | 1/1999 | Gano et al. | 254/88 |
| 6,517,051 | B1 * | 2/2003 | Cavanaugh | 254/88 |
| 7,114,210 | B2 * | 10/2006 | Heinz | 14/69.5 |
| RE41,851 | E * | 10/2010 | Heinz | 14/69.5 |
| 2006/0027794 | A1 * | 2/2006 | Heinz | 254/88 |
| 2006/0043350 | A1 * | 3/2006 | Branstetter | 254/88 |
| 2009/0189130 | A1 * | 7/2009 | Heinz | 254/88 |

* cited by examiner

*Primary Examiner* — Lee D Wilson

(74) *Attorney, Agent, or Firm* — Barlow, Josephs & Holmes, Ltd.

(57) ABSTRACT

A modular vehicle ramp system is provided for elevating all four wheels of a vehicle off of the ground to allow a user easy access beneath the elevated vehicle. The components are modular allowing the ramp system to be employed in several different reconfigurable arrangements. A first embodiment provides one wheel support and one ramp that releasably engages with the wheel support. In another embodiment, at least two wheel supports are employed with two corresponding ramps releasably engaged therewith. Finally in another embodiment, two bridge sections extend between two wheel supports positioned at the front and two wheel supports positioned at the rear. Two ramps are releasably engaged with either the two forward or rear wheel supports such that a car can be driven up the ramps and over the bridge sections such that the four vehicle wheels are supported on the four wheel supports.

14 Claims, 3 Drawing Sheets

MODULAR VEHICLE RAMP SYSTEM

CROSS-REFERENCE TO RELATED APPLICATIONS

This application is related to and claims priority from earlier filed U.S. Provisional Patent Application No. 61/062,200, filed Jan. 25, 2008.

BACKGROUND OF THE INVENTION

The present invention relates generally to a vehicle ramp system for elevating all four wheels of a vehicle off of the ground to create clearance under the vehicle for a person to easily work therebeneath. More specifically, the present invention relates to a modular vehicle ramp system for elevating all four wheels of a vehicle off of the ground to create clearance under the vehicle wherein the ramp is reconfigurable with a vehicle positioned thereon to allow a user easy access beneath the elevated vehicle.

Typically in the art, portable car ramps are used for increasing vertical clearance beneath a vehicle. In this manner, the ramps are positioned on a flat horizontal garage floor, driveway, yard or like support medium, with the wheels of the vehicle elevated thereon so that a worker can repair or service the vehicle from the underside thereof. A typical portable car ramp includes a bottom structure that engages with a support surface in a stable manner, a generally level wheel support substantially parallel to but elevated above the support surface and an inclined surface that extends from the support surface upwardly to the wheel support. The vehicle wheel is then rolled up the inclined surface to the elevated wheel wherein the wheel of the vehicle is maintained in an elevated position thereby increasing the clearance beneath the vehicle providing access thereto. Should the user desire both that sides of the vehicle frame be elevated, two matching ramps are used, where either both front wheels or both rear wheels are simultaneously rolled up the respective ramps and onto the respective wheel supports.

Such ramps are typically constructed of formed steel, which is painted. This produces a strong, economical ramp but the ramps are relatively heavy. Another approach is to mold the ramps from plastic with internal webs extending between external walls of relatively thin width to achieve adequate strength. While lighter than steel, the plastic ramps are still heavy enough to not be easily handled. Further, these systems are typically not modular in construction and therefore do not provide flexibility in arrangement and use of the ramps.

In the prior art there are several modular wheel ramp assemblies disclosed such as in U.S. Pat. No. 4,920,596, which includes a two level ramp device composed of a first ramp segment attachable at a rear portion to a second ramp segment that itself includes a first support level, which is in turn attachable at a rear portion to a third ramp having a second support level for positioning a car wheel thereon. The design of the first and second ramps requires alignment end-to-end and assembly of the units by positioning each axially before connection to the respective pairs of end brackets. If a car wheel is driven onto the first ramp without the second and third ramps portion attached, the first ramp can "kick-out" or slide away from the wheel due to the limited bottom surface area contacting against the ground surface. Use of this type of ramp device requires assembly before a car wheel progresses to an elevated height to allow aligning of each rear portion of second and third ramps when unweighted to protect the user from "kick-out" by the ramp device. Further, this type of ramp device requires end-to-end alignment for proper cradling by the end brackets extended from each rear portion of each ramp segment, thereby posing an unsafe situation if the operator attempted to assemble or reconfigure the aligned ramp segments while a front or rear wheel is on a first ramp segment and is partially elevated above a ground surface.

A leveling ramp device for a vehicle tire is disclosed in U.S. Pat. No. 4,427,179, that includes a plurality of planar planks that are stacked with their front ends forming a stairway for a wheel to climb, and having rear ends enclosed by a back frame having side members enclosing side wall portions of each stacked plank. Each ramp plank is further held in place by a downwardly projecting dowel that is inserted in the top surface of the next lower ramp plank to maintain alignment of the front portions of the stacked ramp planks. The plurality of ramp planks must be aligned, stacked and enclosed by the back frame before a vehicle tire is moved up the front end surfaces, otherwise the planks will be pushed sideways or backwards without the back frame and interlocking dowels in place. A vehicle tire cannot be positioned in a partially elevated horizontal position other than on an uppermost surface and additional ramp planks must be added before the tire is initially positioned at the uppermost height.

Additionally, an elevating and leveling ramp device for a vehicle wheel is disclosed in U.S. Pat. No. 3,752,441, that is formed using a plurality of hollow blocks having step-like sections that are nestable within the next larger hollow block. The elevating and leveling ramp device allows for extension of each hollow block from the next larger block to form a series of steps on which a vehicle wheel is moved. During extension of respective hollow blocks from the next larger hollow block, the respective blocks are aligned and connected end-to-end, but are not laterally movable for disassembly while the vehicle wheel is positioned on any of the blocks. Therefore, any larger hollow blocks must be added to the ramp device before a vehicle wheel is moved on a low height block or on a middle height block.

In addition to the various problems identified above, another problem encountered in the prior art is the tendency for the bottom edges of the sidewalls of both the steel and molded plastic ramps to sink into gravel or earth surfaces or to be easily tipped when in use. Further, the edges of side walls of formed steel ramps can damage asphalt paving and the side walls of plastic ramps can be easily collapsed if the ramp is misaligned with the vehicle wheels to a degree that the tires push the ramp sideways, bending the same such that the walls collapse under the weight of the vehicle.

There is therefore a need for a modular ramp construction that can be reconfigured with the vehicle in place thereon to allow easier access to the underside of the vehicle. There is a further need for a lightweight but durable and stable modular ramp that is useable on softer surfaces and which can easily be rearranged into many different configurations. There is still a need for a modular ramp system that can easily be rearranged into many different configurations and is constructed using lightweight monolithic materials that are highly durable while also increasing the overall stability of the ramp system.

BRIEF SUMMARY OF THE INVENTION

In this regard, the present invention provides a vehicle ramp system for elevating all four wheels of a vehicle off of the ground to create clearance under the vehicle for a person to easily work therebeneath. Further, the present invention provides a modular vehicle ramp system for elevating all four wheels of a vehicle off of the ground to create clearance under the vehicle wherein the ramp is reconfigurable with a vehicle positioned thereon to allow a user easy access beneath the elevated vehicle. As a result a modular ramp system according to the present invention provides a very solid car ramp suitable for lifting a wide variety of vehicles, particularly vehicles with very low clearance.

As can be appreciated upon a reading of the following specification and claims, a multi-component ramp system is provided wherein each of the components is modular thereby allowing the ramp system to be employed in several different reconfigurable arrangements. In its simplest form, the ramp system includes at least one solid block core formed as a wheel support and at least one angled ramp that releasably engages with the wheel support. In another embodiment, at least two wheel supports are employed with two corresponding ramps releasably engaged therewith such that two vehicle wheels can be elevated simultaneously. Finally in another embodiment, the present invention employs four wheel supports positioned in spaced apart relation corresponding to the spacing of the wheels of the vehicle to be supported thereon. Two bridge sections extend between two of the wheel supports positioned at the front and two of the wheel supports positioned at the rear such that the bridge sections have an upper surface that is substantially level with the top surfaces of the wheel supports. At least two ramps are releasably engaged with either the two forward or rear wheel supports such that a car can be driven up the ramps and over the bridge sections such that the four vehicle wheels are supported on the four wheel supports.

In each of the embodiments, all of the components described above are preferably monolithically constructed using a lightweight composite comprised of an expanded foam plastic core, in particular, a expanded polystyrene foam which is encapsulated in a high tensile strength polyurea coating of sufficient thickness to provide a durable surface when cured and create a strong composite structure. The polyurea coating is preferably applied by spraying liquid components onto the foam plastic core so as to create a textured surface for good tire traction. The polyurea coating may optionally be top coated with a hard coat of an abrasion and water resistant color stable polyurea formulation. The combination of the core and high tensile strength polyurea coating creates a sufficiently strong and durable structure to be very well suited for use as a vehicle service ramp. In addition to the construction described above, the present invention may also be implemented using other lightweight laminates such as fiberglass, carbon fiber composites and composite nanomaterials. Further, each of the above may also include core supports in the form of wood and/or metal panels and/or bulkheads.

The block core can be easily and economically cut out in a great variety of shapes without requiring special tooling, with the polyurea thereafter applied as a coating as by spraying the block core to allow ramps of many configurations to be manufactured without incurring significant tooling costs. Very low angle approach ramps can be easily provided which are lightweight so as to be practical to use despite being of relatively long length. The solid footprint of the ramps of this construction creates a stable ramp that has a greatly reduced tendency to sink into soft surfaces.

For heavier duty designs, additional strengthening features can be employed to resist compressive loads. This may include one or more panels of plywood or other sturdy material such as plastic or metal, oriented on edge or layed flat within the core, braced by the presence of the expanded polystyrene foam of the core encasing the panels.

Therefore it is an object of the present invention to provide a modular ramp construction that can be reconfigured with the vehicle in place thereon to allow easier access to the underside of the vehicle. It is a further object of the present invention to provide a lightweight but durable and stable modular ramp that is useable on softer surfaces and which can easily be rearranged into many different configurations. It is still a further object of the present invention to provide a modular ramp system that can easily be rearranged into many different configurations and is constructed using lightweight monolithic materials that are highly durable while also increasing the overall stability of the ramp system.

These together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
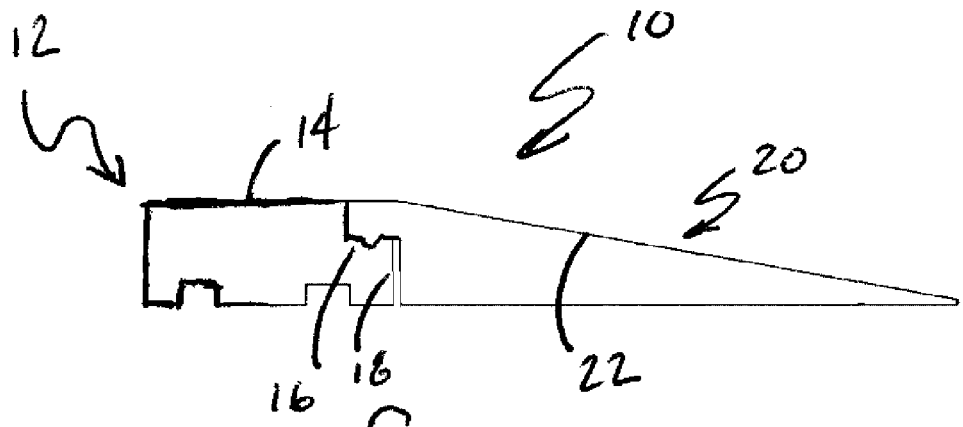
FIG. 1 is a side view of a modular ramp system in accordance with a first embodiment of the present invention.

Now referring to the drawings, the modular ramp system is shown and generally illustrated in the figures. As can be seen a modular vehicle ramp system is provided for elevating from one to all four wheels of a vehicle off of the ground to create clearance under the vehicle wherein the ramp is reconfigurable with a vehicle positioned thereon to allow a user easy access beneath the elevated vehicle. As a result a modular ramp system according to the present invention provides a very solid car ramp suitable for lifting a wide variety of vehicles, particularly vehicles with very low clearance.

Figure 2:
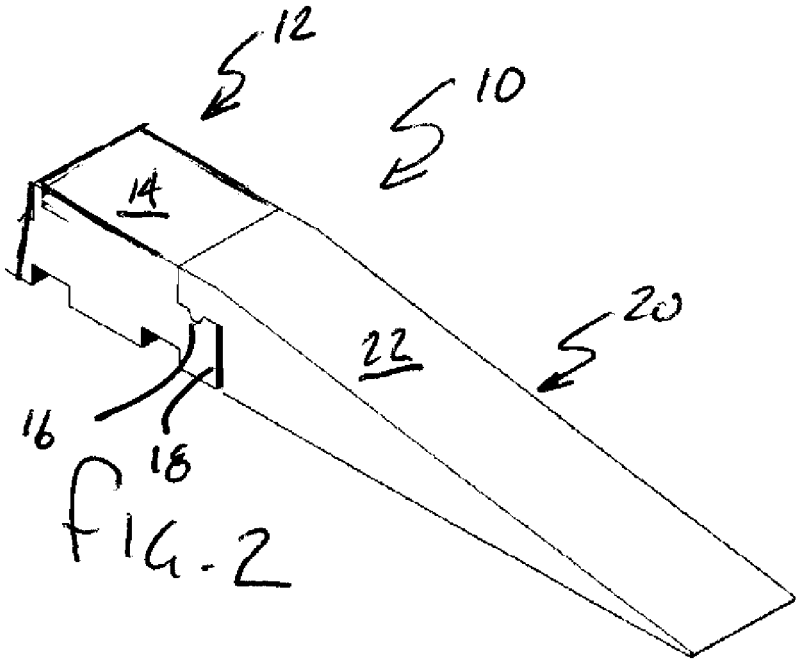
FIG. 2 is a front perspective view of the modular ramp of FIG. 1.

Turning now to the drawings, FIGS. 1 and 2 depict in its simplest form a multi-component ramp system 10 wherein each of the components is modular thereby allowing the ramp system 10 to be employed in several different reconfigurable arrangements. The ramp system 10 includes at least one wheel support 12 having a top support surface 14 and an engaging surface 16 on a front face 18 thereof. Further, at least one ramp 20 can be seen positioned adjacent the front face 18 of the wheel support 12 wherein the ramp 20 is releasably engaged with engaging surface 16 formed therein. The ramp 20 further includes a ramp surface 22 that extends upwardly to the top support surface 14 on the wheel support 12. The engaging surfaces are shown here as corresponding male and female keyway formations but may alternately be pins, grooves, channels, dovetails or any other suitable mating formation know in the art. Furtherwhile the engaging surfaces are shown as being oriented horizontally, any other orientation such as vertical or oblique would equally fall within the spirit and scope of the present invention.

Figure 3:
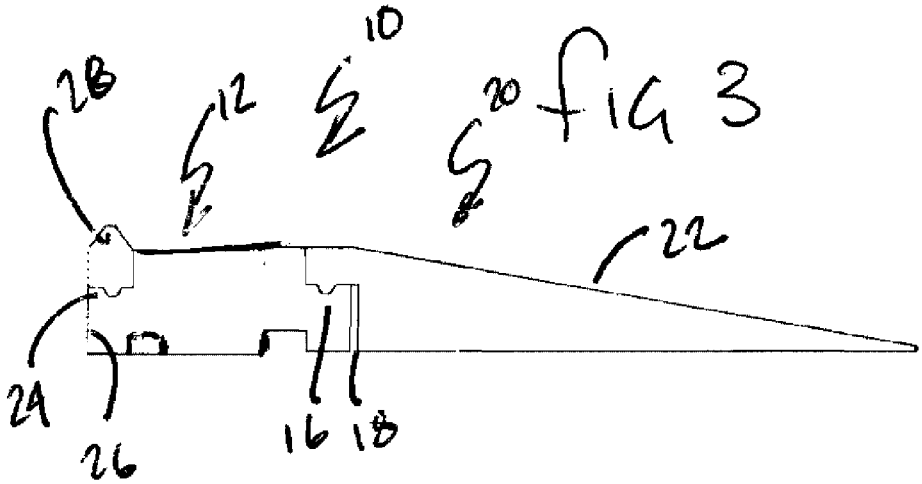
FIG. 3 is a side view of a modular ramp system in accordance with a second embodiment of the present invention.
Figure 4:
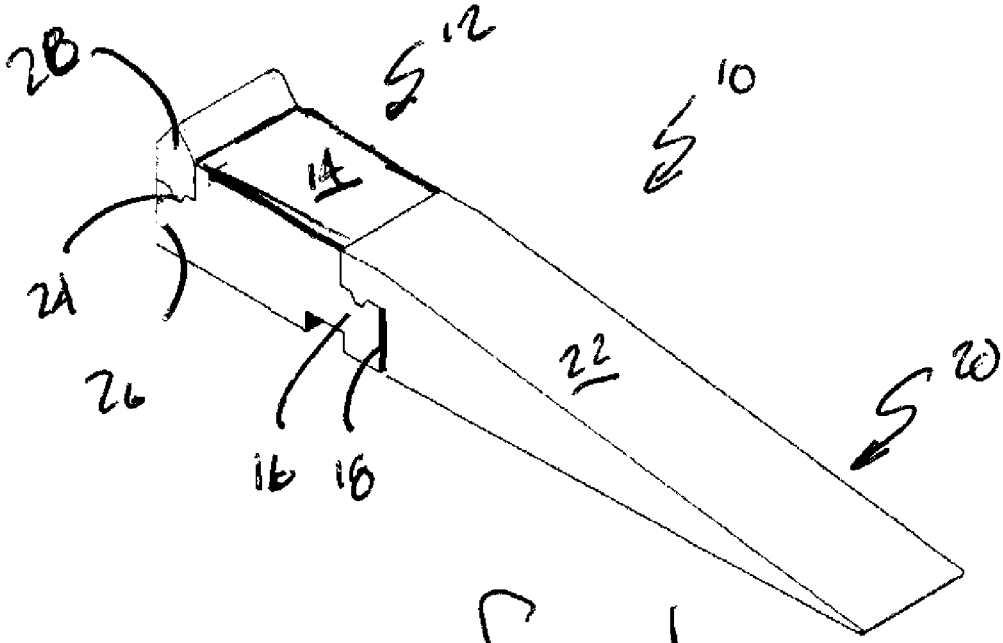
FIG. 4 is a front perspective view of the modular ramp of FIG. 3.

Turning to FIGS. 3 and 4, the wheel support 12 can be seen to include a second engaging surface 24 on a rear surface 26 thereof. This second engaging surface 24 is formed to be modular and of the same size and configuration as the first engaging surface 16 at the front of the wheel support 12. In these figures the rear engaging surface 24 can be seen to receive and retain a wheel stop 28. The wheel stop 28 is provided to prevent a vehicle wheel positioned on the support surface 14 from rolling too far forward such that it rolls completely off of the support surface 14. Additionally, however, the wheel stop 28 can be removed and the ramp 20 can be repositioned to allow the vehicle to be taken down from the support surface 14 by continuing in a forward direction as desired by the user.

It should be appreciated that the structures shown in the previous figures may simply be duplicated such that at least two wheel supports 12 are employed with two corresponding ramps 20 releasably engaged therewith such that two vehicle wheels can be elevated simultaneously. In this regard the two wheel supports 12 and two ramps 20 are positioned in spaced apart relation based on the spacing of wheels on a vehicle to be supported thereon. In this regard both front wheels, both rear wheels or both wheels along one side of the vehicle can be simultaneously elevated.

Figure 5:
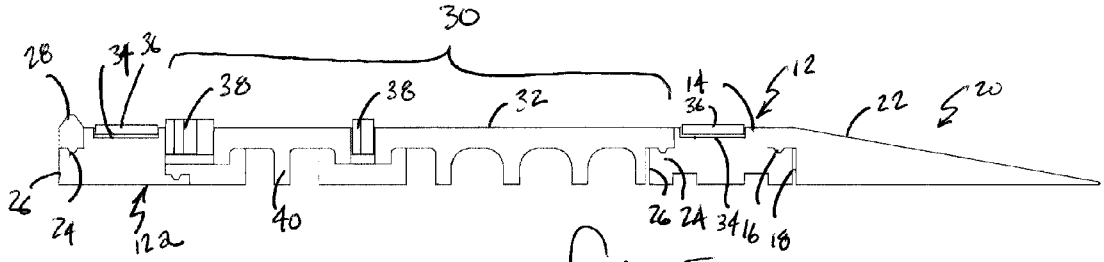
FIG. 5 is a side view of a modular ramp system in accordance with a third embodiment of the present invention.
Figure 6:
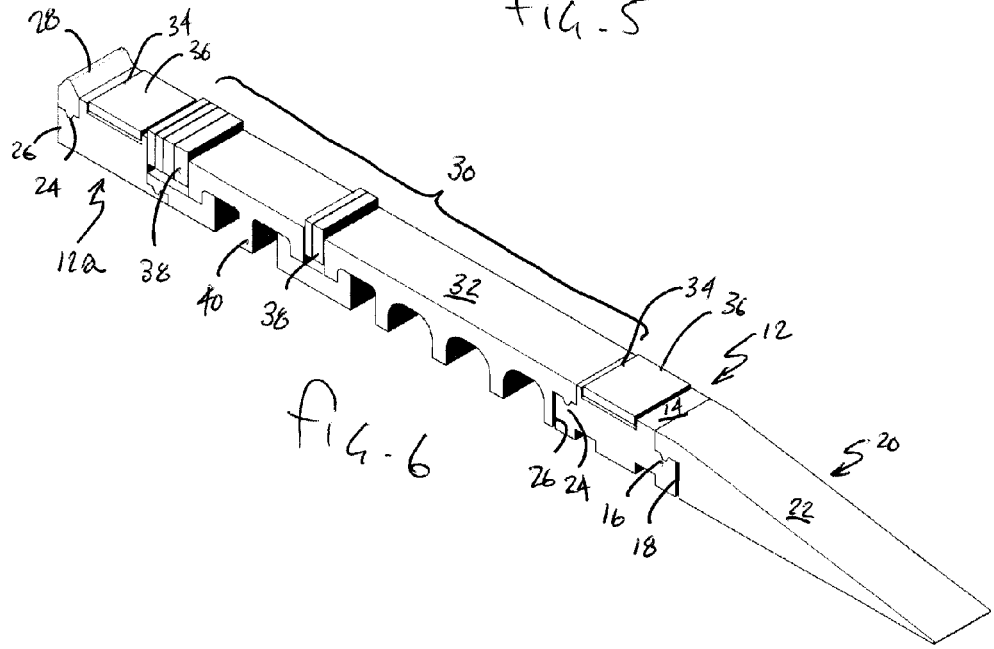
FIG. 6 is a front perspective view of the modular ramp of FIG. 5.

Turning now to FIGS. 5 and 6, in another embodiment, the present invention employs two wheel supports 12, 12*a* positioned in spaced apart relation corresponding to the spacing of the wheels of the vehicle to be supported thereon. A bridge section 30 is provided that extends between the wheel supports 12, 12*a* such that one of the wheel supports 12 is at the front of the bridge section 30 and one of the wheel supports 12*a* is positioned at the rear of the bridge section 30. The bridge section 30 can be seen to include an upper surface 32 that is substantially level with the top support surfaces 14 of the wheel supports 12, 12*a*. A ramp 20 can be seen to be releasably engaged the forward wheel support 12 such that a vehicle can be driven up the ramp 20 and over the bridge section 30 such that two of the vehicles wheels are supported on the wheel supports 12, 12*a*.

As discussed above, the structures can be simply duplicated to provide four wheel supports 12, 12*a* positioned in spaced apart relation corresponding to the spacing of the wheels of the vehicle to be supported thereon. Two bridge sections 30 extend between two of the wheel supports 12 positioned at the front and two of the wheel supports 12*a* positioned at the rear such that the bridge sections 30 have an upper surface 32 that is substantially level with the top support surfaces 14 of the wheel supports 12, 12*a*. At least two ramps 20 are releasably engaged with either the two forward 12 or rear 12*a* wheel supports such that a car can be driven up the ramps 20 and over the bridge sections 30 such that the four vehicle wheels are supported on the four wheel supports 12, 12*a*.

Additionally, the rear wheel supports 12*a* can be seen to include a second engaging surface 24 on a rear surfaces 26 thereof. This second engaging surface 24 is formed to be modular and of the same size and configuration as the first engaging surface 16 at the front of the front wheel supports 12. In these figures the rear engaging surface 24 can be seen to receive and retain a wheel stop 28. The wheel stop 28 is provided to prevent a vehicle wheel positioned on the support surface 14 from rolling too far forward such that it rolls completely off of the support surface 14. Additionally, however, the wheel stop 28 can be removed and the ramp 20 can be repositioned to allow the vehicle to be taken down from the support surface 14 by continuing in a forward direction as desired by the user. It is of further note that the bridge sections 30 and ramps 20 can be selectively removed once the vehicle is positioned on said wheel supports 12, 12*a*. This allows a user to more easily access the underside of the vehicle.

It can also be seen that the wheel supports 12, 12*a* may be formed to include recesses 34 in the top support surfaces 14 thereof. Such recesses 34 may be included to allow additional accessories such as scales 36, turntables or slip plate stands to be positioned on the support surfaces 14 thereby allowing a vehicle positioned thereon to be weighed or aligned. When scales 36 are not provided in the recesses 34, a cap may be placed into the recess 34 to create a smooth flush top support surface 14.

FIGS. 5 and 6 also depict that the bridge sections 30 are adjustable in length. Such length adjustment may be accomplished by any modular means known in the art. In this case the bridge 30 is shown to simply employ shim 38 components and a modular bridge extension member 40 to increase the length thereof. This allows the modular ramp system to be employed with vehicles having a wide range of wheelbase dimensions.

In each of the embodiments, all of the components described above are monolithically constructed using a lightweight composite comprised of an expanded foam plastic core, in particular, a expanded polystyrene foam which is encapsulated in a high tensile strength polyurea coating of sufficient thickness to provide a durable surface when cured and create a strong composite structure. The polyurea coating is preferably applied by spraying liquid components onto the foam plastic core so as to create a textured surface for good tire traction. The polyurea coating may optionally be top coated with a hard coat of an abrasion and water resistant color stable polyurea formulation. The combination of the core and high tensile strength polyurea coating creates a sufficiently strong and durable structure to be very well suited for use as a vehicle service ramp.

As stated above, the components of the ramp system are preferably formed using an expanded polystyrene foam (EPS) of a density on the order of 1.5 to 6 pounds per cubic foot. The heavier densities of 5 or 6 pounds per cubic foot can be used for heavy-duty ramps. The core 12 is encased within a polyurea coating 28 which is preferably sprayed on so as to create a coating having a textured finished surface to enhance tire traction. This polyurea coating which is sprayed onto the core is formulated and of sufficient thickness to develop adequate tensile strength so that the ramp 10 may accommodate the weight of passenger cars. Polyurea may be formulated in a number of ways. A suitable type of polyurea is F1-2546 POLY available from VOLATILE FREE, INC. of Brookfield, Wis. 53045. The thickness of the polyurea coating will typically be on the order of 35-65 mils of this material. It will provide adequate tensile strength for most applications. Even thinner coatings may be adequate, as a tensile strength of 2500 psi is obtained with a 25-mil thickness of 58 (Shore D) hardness suitable for light duty applications. Additionally, a topcoat may be applied such as Polyshield HM-7030 available from Specialty Products, Inc. that has a high degree of water resistance. In addition to the construction described above, the present invention may also be implemented using other lightweight laminates such as fiberglass, carbon fiber composites and composite nanomaterials. Further, each of the above may also include core supports in the form of wood and/or metal panels and/or bulkheads.

This construction allows a wide variety of ramp configurations, even custom ordered configurations, to be made very economically with minimal tooling costs. Any configuration of core 12 can be simply cut out of EPS foam by standard cutting tools and then spray coated with polyurea to a suitable coating thickness. Further, the solid bottom of the ramp system components insures good stability and much reduced tendency to sink into soft surfaces. The absence of any nooks or crannies and the hard polyurea coating makes keeping the ramps clean easy.

For heavier duty designs, additional strengthening features can be employed to resist compressive loads. This may include one or more panels of plywood or other sturdy material such as plastic or metal, oriented on edge or layed flat within the core, braced by the presence of the expanded polystyrene foam of the core encasing the panels. These panels brace the ramp components to greatly enhance the overall compressive strength of the ramp. In a similar fashion, other internal structures can be used, such as molded plastic shapes. However, it has been found in reinforced ramps made by the above described method are of adequate strength for many automobiles as vehicles up to 6000 pounds gross weight may be safely supported.

It can therefore be seen that the present invention provides a modular ramp construction that can be reconfigured with the vehicle in place thereon to allow easier access to the underside of the vehicle. It can be further seen that the present invention provides a lightweight but durable and stable modular ramp that is useable on softer surfaces and which can easily be rearranged into many different configurations. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A modular ramp system comprising:

two front wheel supports each having a top support surface, a front engaging surface on a front face thereof and a rear engaging surface on a rear face thereof, two rear wheel supports each having a top support surface and a front engaging surface on a front face thereof;

two bridge sections, each releasably engaged between the rear engaging surfaces of the front wheel supports and the front engaging surfaces of the rear wheel supports; and two ramps each releasably engaged with said front engaging surfaces of the front wheel supports, wherein said ramps each include a ramp surface that extends upwardly to said top support surfaces.

2. The modular ramp system of claim 1, wherein said two front wheel supports and said two rear wheel supports are positioned in spaced apart relation based on the spacing of wheels on a vehicle to be supported thereon.

3. The modular ramp system of claim 2, wherein said bridge sections and said ramps can be selectively removed once said vehicle is positioned on said wheel supports.

4. The modular ramp of claim 1, said rear wheel supports further comprising:

rear engaging surfaces on a rear surface thereof, configured to configured to receive and retain a wheel stop.

5. The modular ramp of claim 4, said rear engaging surfaces also configured to releasably engage said ramps with said wheel stops removed.

6. The modular ramp system of claim 1, wherein said two front wheel supports and said two rear wheel supports include recesses therein to receive additional accessories.

7. The modular ramp system of claim 1, wherein said bridge sections are adjustable in length.

8. The modular ramp system of claim 7, further comprising:

bridge extensions that engage with said bridge sections to increase the length thereof.

9. The modular ramp system of claim 1, wherein said wheel supports, ramps and bridge sections are formed with a substantially solid core of polymer foam and a polyurea coating applied over the core to encase and substantially strengthen said core.

10. The modular ramp system of claim 9, wherein said polyurea coating has a thickness of greater than 35 mils.

11. The modular ramp system of claim 9, wherein said polymer foam core is constructed of expanded polystyrene foam.

12. The modular ramp system of claim 9, wherein said core has a panel extending on edge between said top support surface and a bottom side thereof, said panel embedded within said polymer foam core.

13. The modular ramp system of claim 12, wherein said core has a plurality of spaced panels embedded in said polymer foam core.

14. The modular ramp of claim 9, wherein said core has a panel layed flat adjacent the top support surface, said panel embedded within said polymer foam core.

* * * * *